US008886073B2

(12) United States Patent
Atarashi

(10) Patent No.: US 8,886,073 B2
(45) Date of Patent: Nov. 11, 2014

(54) IMAGE FORMING APPARATUS THAT CARRIES OUT IMAGE FORMATION USING ELECTROPHOTOGRAPHIC METHOD

(71) Applicant: Canon Kabushiki Kaisha, Tokyo (JP)

(72) Inventor: Eijiro Atarashi, Tokyo (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/921,292

(22) Filed: Jun. 19, 2013

(65) Prior Publication Data

US 2014/0003832 A1 Jan. 2, 2014

(30) Foreign Application Priority Data

Jun. 29, 2012 (JP) ..... 2012-146879

(51) Int. Cl.
*G03B 15/00* (2006.01)
*G03G 15/00* (2006.01)

(52) U.S. Cl.
CPC .... *G03G 15/5004* (2013.01); *G03G 2215/0132* (2013.01); *G03G 15/80* (2013.01)
USPC ..... 399/88

(58) Field of Classification Search
CPC ..... G03G 15/5004; G03G 15/80
USPC ..... 399/88
See application file for complete search history.

(56) References Cited

U.S. PATENT DOCUMENTS

2013/0058674 A1* 3/2013 Suzuki et al. ..... 399/70
2013/0188979 A1* 7/2013 Okada ..... 399/88
2013/0322898 A1* 12/2013 Koseki et al. ..... 399/37
2014/0003832 A1* 1/2014 Eijiro ..... 399/88

FOREIGN PATENT DOCUMENTS

JP 2008-203880 A 9/2008

* cited by examiner

*Primary Examiner* — W B Perkey
(74) *Attorney, Agent, or Firm* — Rossi, Kimms & McDowell LLP

(57) ABSTRACT

An image forming apparatus which is capable of extending the life of relay contacts even when a noise filter circuit is disposed downstream of relays on paths over which commercial alternating-current power is supplied. First and second relays disposed in respective ones of two supply paths that are different in polarity, over which power is supplied, and switch supply and shut off of the power. The noise filter circuit filers out noise on the supply paths. When supply of alternating-current power to a power supplied device disposed downstream of the noise filter is started, one of the relays is switched into supply state first, and then the other one is switched into supply state so that the number of times each relay is switched into supply state first per predetermined number of times power is supplied can be substantially equal between the first and second relays.

15 Claims, 8 Drawing Sheets

POWER SUPPLY UNIT
800'
821
110
CONTROLLER
NONVOLATILE MEMORY
176
LOAD
813
806
CONTROLLER POWER-SUPPLY DEVICE
807
LOAD POWER-SUPPLY DEVICE
819
818
816
817
820
805
811
803
804
814
815
812
SW
801
RELAY A
802
RELAY B
809
810
550

IMAGE FORMING APPARATUS THAT CARRIES OUT IMAGE FORMATION USING ELECTROPHOTOGRAPHIC METHOD

BACKGROUND OF THE INVENTION

1. Field of the Invention

The present invention relates to an image forming apparatus such as a copier, a printer, or a facsimile which carries out image formation using an electrophotographic method.

2. Description of the Related Art

In recent years, as image forming apparatuses have become increasingly energy-efficient, not only power reduction during operation and on standby but also power reduction during power-off and in energy-saving mode has become a very important issue as typified by ErP directive Lot 6 which is the European regulation.

Conventionally, in an ordinary arrangement of an input circuit that supplies commercial AC (alternating-current) power to an apparatus, a noise filter circuit placed on a commercial AC power line is disposed upstream of a power shutdown/energization device such as a relay (see, for example, Japanese Laid-Open Patent Publication (Kokai) No. 2008-203880). In general, a noise filter circuit is comprised of a common mode choke coil, an X-capacitor, and a discharge resistor. A discharge resistor is intended to discharge residual electrical charge in the X-capacitor within a predetermined period of time specified by safety standards when a power plug is disconnected from a commercial AC power source. Thus, a discharge resistor is indispensable for a noise filter circuit, and dispensing with it is very difficult. An X-capacitor, which is a common name of an across-the-line capacitor, is placed across an AC line and intended to filter out noise. Depending on the capacity of an X-capacitor, a constant of about 100 kΩ to 500 kΩ is commonly selected as the resistance value of a discharge resistor. While commercial AC power is being supplied, electric current constantly flows through a discharge resistor, and hence a power loss caused by the discharge resistor occurs. When the resistance value of a discharge resistor lies inside the above range, and an input voltage is AC 200 V, a power loss of 0.08 W to 0.4 W caused by the discharge resistor occurs. This is not a negligible loss during power-off and in sleep mode when an apparatus is plugged in.

A discharge resistor is required so as to comply with a discharge time specified by safety standards as described above, and hence it is very difficult to increase resistance value more than is necessary or dispense with the discharge resistor itself. For this reason, a noise filter circuit is disposed downstream of a relay, and the relay is turned off during power-off and in sleep mode so as to inhibit electric current from flowing through a discharge resistor so that a power loss caused by the discharge resistor can be prevented.

However, if a noise filter circuit is disposed downstream of a relay, an X-capacitor as well should be inevitably disposed downstream of the relay, and when the relay is on, inrush current at the X-capacitor occurs. A relay contact reaches the end of its life when a surface condition thereof deteriorates, and contact sticking or poor contact occurs. In particular, a main factor that causes the surface of a relay contact to deteriorate is arc discharge occurring when a relay is turned and off. As the amount of inrush current increases, the amount of arc discharge occurring when the relay is turned on also increases.

Moreover, in recent years, automatic shifting into power-off and energy-saving mode has been required from the standpoint of energy conservation, and as a result, the number of times a relay is turned on and off is increasing. Under such circumstances, if a noise filter circuit is disposed downstream of a relay, inrush current will occur, and in addition, the number of times inrush current occurs will increase, causing a significant decrease in the life of a relay contact.

SUMMARY OF THE INVENTION

The present invention provides an image forming apparatus which is capable of extending the life of relay contacts even in a case where a noise filter circuit is disposed downstream of relays on a path over which commercial alternating-current power is supplied.

Accordingly, a first aspect of the present invention provides an image forming apparatus comprising first and second switching units configured to be disposed in respective ones of two supply paths that are different in polarity and over which alternating-current power from a commercial alternating-current power supply is supplied, and switch supply and shut off of the alternating-current power, noise filter circuits configured to be disposed downstream of the first and second switching units and filter out noise on the two supply paths, a power supplied device configured to be disposed downstream of the noise filter circuit and be supplied with the alternating-current power through the noise filter circuit, and a control unit configured to, when supply of the alternating-current power from the commercial alternating-current power supply to the power supplied device is started, control the first and second switching units to switch one of the first and second switching units into supply state and then switch the other one of the first and second switching units into supply state so that the number of times the first switching unit is switched into supply state first and the number of times the second switching unit is switched into supply state first can be equal per predetermined number of times the alternating-current power is supplied to the power supplied device.

Accordingly, a first aspect of the present invention provides an image forming apparatus comprising first and second switching units configured to be disposed in respective ones of two supply paths that are different in polarity and over which alternating-current power from a commercial alternating-current power supply is supplied and switch supply and shut off of the alternating-current power, noise filter circuits configured to be disposed downstream of the first and second switching units and filter out noise on the two supply paths, a power supplied device configured to be disposed downstream of the noise filter circuits and be supplied with the alternating-current power through the noise filter circuit, a control unit configured to, when supply of the alternating-current power from the commercial alternating-current power supply to the power supplied device is started, switch one of the first and second switching units into supply state and then switch the other one of the first and second switching units into supply state, and a storage unit configured to store information that specifies the one of the first and second switching units switched into supply state first when supply of the alternating-current power from the commercial alternating-current power supply to the power supplied device is started last time, wherein every time supply of the alternating-current power from the commercial alternating-current power supply to the power supplied device is started, the control unit determines which one of the first and second switching units should be switched into supply state first based on the information stored in the storage unit.

According to the present invention, because the number of times each of the plurality of relays is turned on first is leveled out so that inrush current can be equally passed through them, the number of times each relay is turned on first can be smaller than the number of times the power to the apparatus is turned on, and the life of the relay contacts can be extended.

Further features of the present invention will become apparent from the following description of exemplary embodiments (with reference to the attached drawings).

DESCRIPTION OF THE EMBODIMENTS

The present invention will now be described in detail with reference to the drawings showing embodiments thereof.

Figure 1:
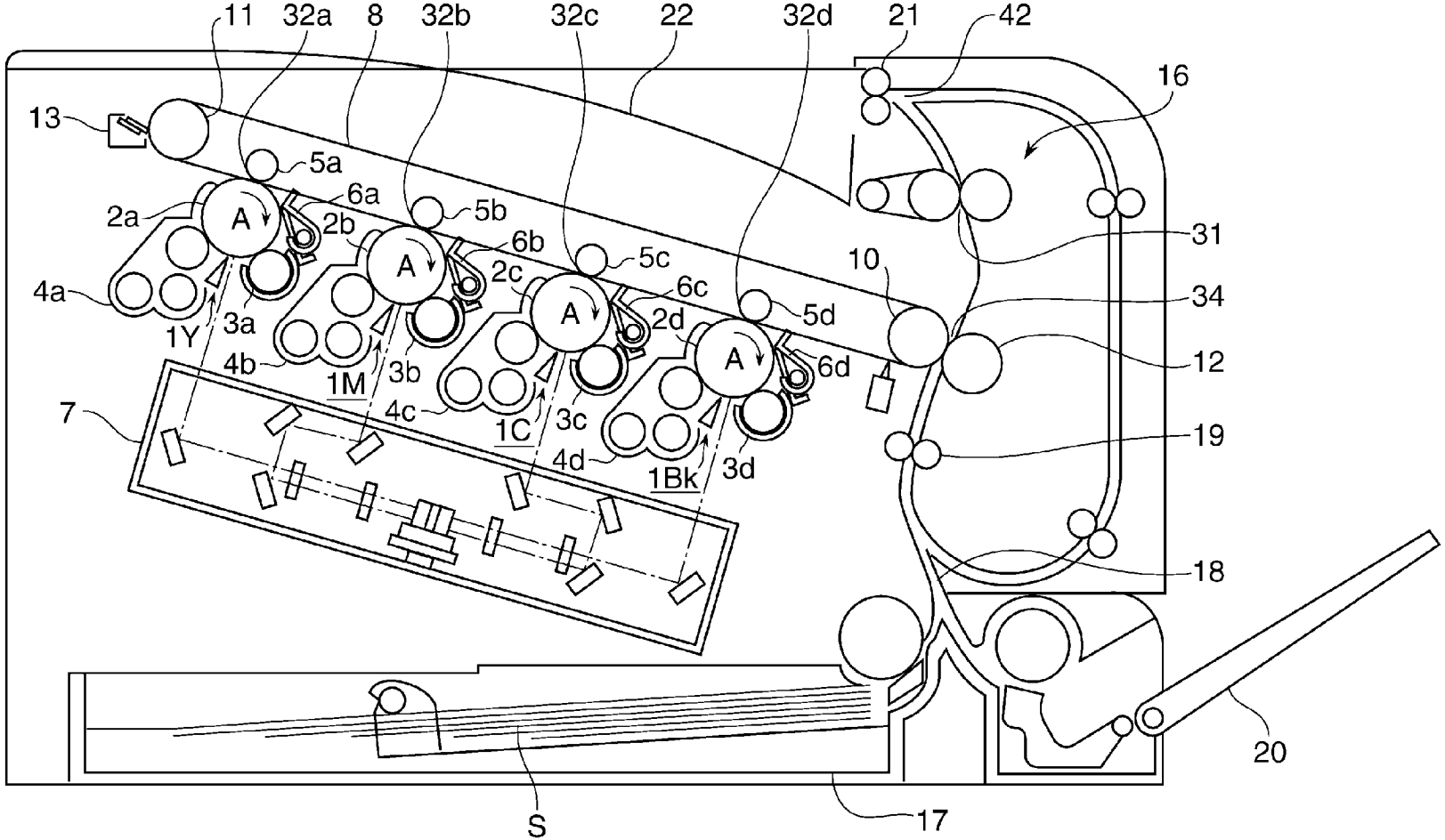
FIG. 1 is a cross-sectional view schematically showing an arrangement of a color printer to which an image forming apparatus according to a first embodiment of the present invention is applied.

FIG. 1 is a cross-sectional view schematically showing an arrangement of a color printer to which an image forming apparatus according to a first embodiment of the present invention is applied.

Referring to FIG. 1, the color printer according to the present embodiment has four image forming sections (hereafter referred to as "the image forming units") 1Y, 1M, 1C, and 1Bk that form images of respective colors, yellow (Y), magenta (M), cyan (C), and black (Bk). These four image forming units 1Y, 1M, 1C, and 1Bk are arranged in a row at regular intervals.

The image forming units 1Y, 1M, 1C, and 1Bk are equipped with drum-type electrophotographic photosensitive members (hereafter referred to as "the photosensitive drums") 2*a* to 2*d*, respectively. Primary chargers 3*a* to 3*d*, developing devices 4*a* to 4*d*, transfer rollers 5*a* to 5*d*, and drum cleaning devices 6*a* to 6*d* are placed around the respective photosensitive drums 2*a* to 2*d*. A laser exposure device 7 is disposed below an area between the primary chargers 3*a* to 3*d* and the developing devices 4*a* to 4*d*.

Yellow toner, magenta toner, cyan toner, and black toner are stored in the developing devices 4*a* to 4*d*, respectively.

The photosensitive drums 2*a* to 2*d* are rotatively driven in a direction indicated by an arrow A in the figure at a predetermined process speed by a drive unit (not shown).

The primary chargers 3*a* to 3*d* uniformly charge surfaces of the respective photosensitive drums 2*a* to 2*d* to a predetermined negative potential using a charging bias applied from a charging bias supply (not shown).

The developing devices 4*a* to 4*d* each have toner stored therein and attach toner of the respective colors to electrostatic latent images, which are formed on the respective photosensitive drums 2*a* to 2*d*, to develop (visualize) the electrostatic latent images.

The transfer rollers 5*a* to 5*d* are disposed in respective primary transfer units 32*a* to 32*d* so as to be able to abut against the respective photosensitive drums 2*a* to 2*d* via an intermediate transfer belt 8.

The drum cleaning devices 6*a* to 6*d* each have a cleaning blade or the like for removing toner having not been transferred and remaining on the photosensitive drums 2*a* to 2*d* after primary transfer.

The intermediate transfer belt 8 is disposed on upper sides of the photosensitive drums 2*a* to 2*d* and extended between a belt driving roller 10 and a tension roller 11. The belt driving roller 10, which applies drive force to the intermediate transfer belt 8, is disposed in a secondary transfer unit 34 so as to be able to abut against the secondary transfer roller 12 via the intermediate transfer belt 8. The tension roller 11, which is placed at such a location as to face the belt driving roller 10 across the primary transfer units 32*a* to 32*d*, apply tension to the intermediate transfer belt 8.

A belt cleaning device 13 is disposed outside the intermediate transfer belt 8 and in the vicinity of the tension roller 11. The belt cleaning device 13 removes and collects toner having not been transferred and remaining on a surface of the intermediate transfer belt 8.

A fixing device 16, which has a vertical path configuration, is disposed downstream of the secondary transfer unit 34 in a direction in which a sheet S is conveyed.

The laser exposure device 7 is comprised of a laser light-emitting device, which emits light according to a time-series digital pixel signal of supplied image information, a polygon lens, a reflection mirror, and so on. The laser exposure device 7 exposes surfaces of the photosensitive drums 2*a* to 2*d*, which have been charged by the respective primary chargers 3*a* to 3*d*, to light, thereby forming electrostatic latent images of respective colors corresponding to image information on the surfaces of the photosensitive drums 2*a* to 2*d*.

It should be noted that although in the present embodiment, the color printer is taken as a concrete example of the image forming apparatus, this is not limitative, but any of a color copier, a facsimile, and a multifunctional peripheral incorporating the functionality of a color copier, a facsimile, and a printer in one may be adopted. Also, not only those which form color images but also those which form only monochrome images may be used.

A description will now be given of an image forming operation carried out by the color printer according to the present embodiment.

When an image formation start signal is generated, the photosensitive drums 2*a* to 2*d* of the image forming units 1Y, 1M, 1C, and 1Bk start rotating at a predetermined process speed. Then, the surfaces of the photosensitive drums 2*a* to 2*d* are uniformly negatively charged by the respective primary chargers 3*a* to 3*d*. The laser exposure device 7 outputs a laser beam, which corresponds to an externally input color-separated image signal, from the laser light-emitting device. This laser beam exposes the surfaces of the photosensitive drums 2*a* to 2*d* to light by way of the polygon lens, the reflection mirror, and so on. As a result, electrostatic latent images of the respective colors are formed on the photosensitive drums 2*a* to 2*d*.

After that, first, yellow toner is attached to the electrostatic latent image formed on the photosensitive drum 2*a* by the developing device 4*a* to which a developing bias of the same polarity as the polarity (negative polarity) to which the photosensitive drum 2*a* is charged has been applied, so that the electrostatic latent image formed on the photosensitive drum 2*a* is visualized as a yellow toner image. This yellow toner image is primarily transferred onto the intermediate transfer belt 8, which is being moved, in the primary transfer unit 32*a* between the photosensitive drum 2*a* and the transfer roller 5*a* by the transfer roller 5*a* to which the primary transfer bias (of a positive polarity opposite to toner). At this time, toner having not been transferred and remaining on the photosensitive drum 2*a* is scraped off by the cleaner blade or the like provided in the drum cleaning device 6*a* and collected.

The intermediate transfer belt 8 onto which the yellow toner image has been transferred moves toward the image forming unit 1M. Then, in the image forming unit 1M as well, a magenta toner image formed on the photosensitive drum 2*b* is superposed on the yellow toner image, which lies on the intermediate transfer belt 8, in the primary transfer unit 32*b* using the same procedure as the primary transfer operation carried out as described above by the image forming unit 1Y.

Subsequently, in the primary transfer units 32*c* and 32*d*, cyan and black toner images formed on the photosensitive drums 2*c* and 2*b* of the image forming units 1C and 1Bk are successively superposed on the yellow and magenta toner images transferred onto the intermediate transfer belt 8 in the superposed manner. As a result, full-color toner images are formed on the intermediate transfer belt 8.

Then, a sheet S is fed in synchronization with the timing with which a leading end of the full-color toner images on the intermediate transfer belt 8 moves to the secondary transfer unit 34 between the belt driving roller 10 and the secondary transfer roller 12. Specifically, the sheet S is fed from a selected one of a sheet feed cassette 17 and a manual feed tray 20 to pass through a conveying path 18 and conveyed to the secondary transfer unit 34 by registration rollers 19. The full-color toner images are secondarily transferred in a collective manner onto the sheet S conveyed to the transfer unit 34 by the secondary transfer roller 12 with a secondary transfer bias (of a positive polarity opposite to toner) applied thereto.

The sheet S onto which the full-color toner images have been transferred is conveyed by the fixing device 16, which in turn heats and pressurizes the full-color toner images to thermally fix them to a surface of the sheet S. The sheet S with the toner images thermally fixed thereto is discharged onto a discharged sheet tray 22 on an upper side of the main body by sheet discharging rollers 21, and this completes the sequential image forming operation. It should be noted that stoner having not been transferred and remaining on the intermediate transfer belt 8 is removed and collected by the belt cleaning device 13.

The image forming operation described above is an operation performed in the case of single-sided image formation. The color printer according to the present embodiment also has a double-sided image forming function, but this is not an essential feature of the present invention, and hence description thereof is omitted.

Figure 2:
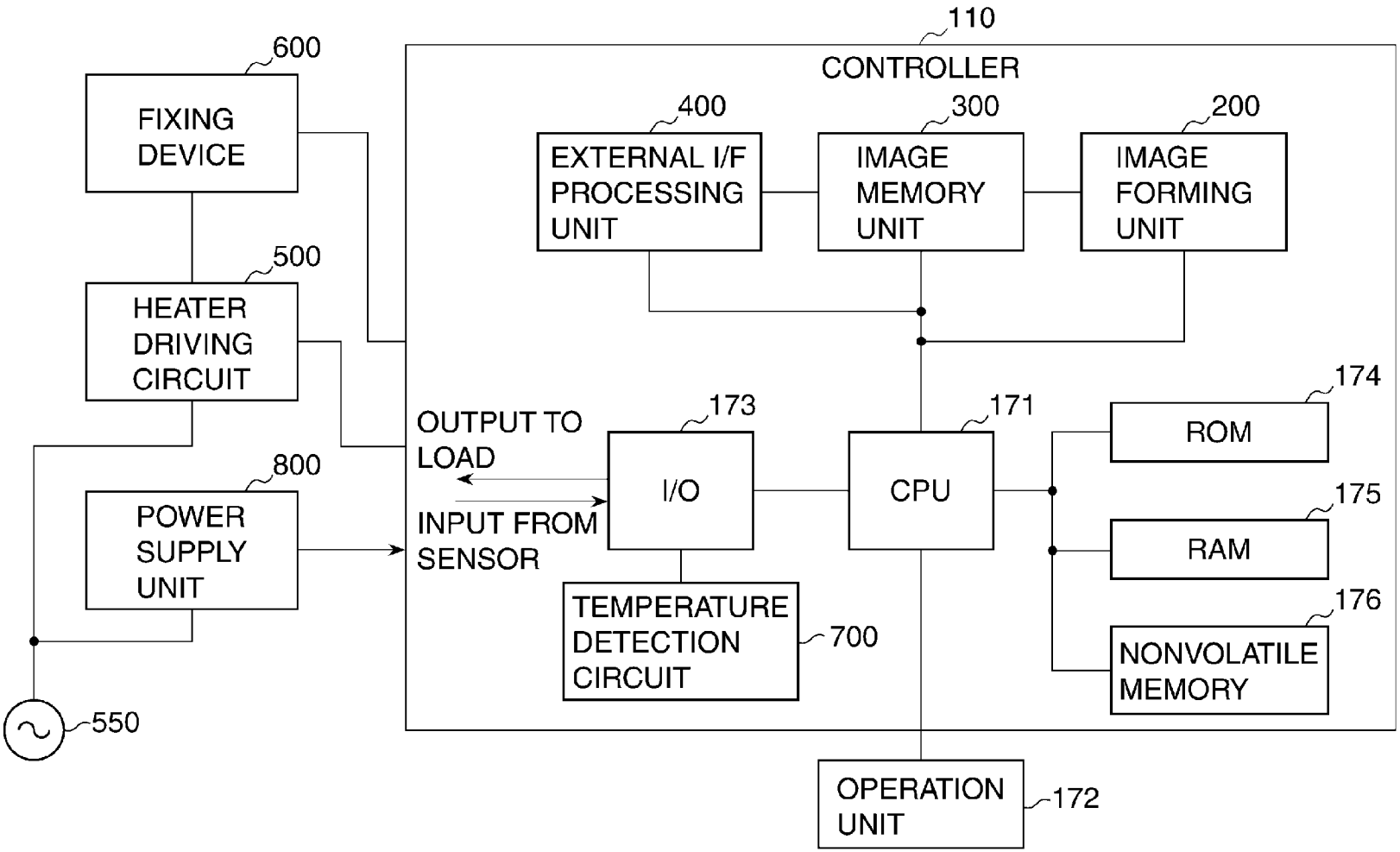
FIG. 2 is a block diagram schematically showing an arrangement of a controller and its vicinity in the color printer appearing in FIG. 1.

FIG. 2 is a block diagram schematically showing an arrangement of a controller 110 and its vicinity in the color printer according to the present embodiment.

Referring to FIG. 2, the controller 110 has a CPU (central processing unit) 171. The CPU 171 carries out centralized control of the color printer according to the present embodiment.

The controller 110 also has a ROM (read-only memory) 174, a RAM (random access memory) 175, a nonvolatile memory 176, and an I/O port 173.

A control program is stored in the ROM 174, and the CPU 171 executes this control program to perform image formation by sequentially controlling input and output via the I/O port 173. The RAM 175 temporarily holds control data and is also used as a work area for computations associated with control. The nonvolatile memory 176 stores data to be held even when the power to the color printer according to the present embodiment is off. Connected to the I/O port 173 are various drive loads (not shown) such as a motor and a clutch, and a sensor (not shown) that detects the position of a sheet S or the like. A heater driving circuit 500 and a temperature detection circuit 700 are also connected to the I/O port 173.

The heater driving circuit 500 supplies power from a commercial AC power supply 550 to a fixing device 600 and a fixing heater disposed in the fixing device 600. The temperature detection circuit 700 has a temperature sensor (not shown), which is disposed in the fixing device 600, connected thereto, and detects the temperature of the fixing device 600 based on a detection signal from the temperature sensor.

The controller 110 also has an external I/F processing unit 400, an image memory unit 300, and an image forming unit 200.

The external I/F processing unit 400 sends and receives image data, processing data, and so on to and from an external apparatus such as a PC (personal computer). The image memory unit 300 stores image data received by the external I/F processing unit 400. The image forming unit 200 generates an image signal, which is to be used for exposure control by the laser exposure device 7, based on line image data transferred from the image memory unit 300.

The CPU 171 is connected to the I/O port 173, the ROM 174, the RAM 175, the nonvolatile memory 176, the image forming unit 200, the image memory unit 300, and the external I/F processing unit 400 via an address bus and a data bus.

An operation unit 107 is connected to the CPU 171 of the controller 110, and the CPU 171 produces various displays on the operation unit 107 and receives key inputs to the operation unit 107. By way of the operation unit 107, a user instructs the CPU 171 to change image forming operation modes and displays. The CPU 171 displays, on the operation unit 107, statuses of the color printer according to the present embodiment and operation modes configured according to key inputs.

The controller 110 is supplied with power from a power supply unit 800. The power supply unit 800 has a controller power-supply device 806 (refer to FIG. 3) and a load power-supply device 807 (refer to FIG. 3). The controller power-supply device 806 supplies DC (direct-current) power to the controller 110, and the load power-supply device 807 supplies DC power to the load 813 such as a motor and a clutch (refer to FIG. 3).

Figure 3:
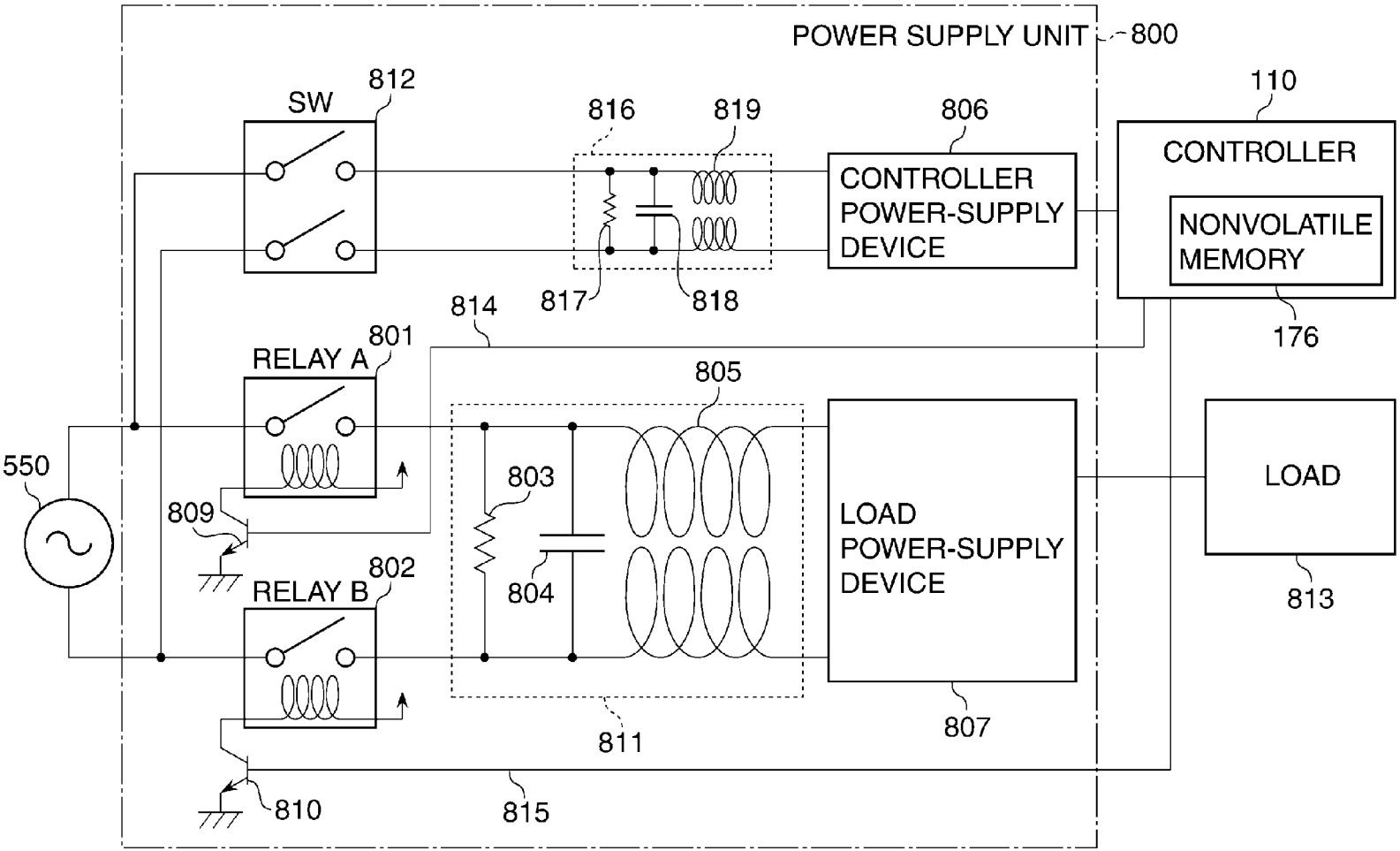
FIG. 3 is a diagram showing in detail an arrangement of a power-supply device appearing in FIG. 2.

FIG. 3 is a diagram showing in detail an arrangement of the power-supply unit 800 appearing in FIG. 2. In FIG. 3, the commercial AC power source 550, the controller 110, and the load 813 as well as the power-supply unit 800 are also shown.

The power-supply unit 800 has a relay A 801, a relay B 802, the controller power-supply device 806, the load power-supply device 807, noise filter circuits 811 and 816, and a power switch (SW) 812.

The power supply unit 800 is supplied with power from the commercial AC power supply 550 (commercial alternating-current power supply). The power switch 812 is disposed on two supply paths of different polarities over which the commercial AC power source 550 is supplied, and the relay A 801 and the relay B 802 are disposed in the respective two supply paths. The noise filter circuit 816 is disposed downstream of the power switch 812, and the controller power-supply device 806 is disposed downstream of the noise filter circuit 816. The noise filter circuit 811 is disposed downstream of the relay A 801 and the relay B 802, and the load power-supply device 807 is disposed downstream of the noise filter circuit 811.

The power switch 812 is operated to turn on and off the power to the whole of the color printer according to the present embodiment. The controller power-supply device 806 supplies DC power to the controller 110.

The relay A 801 and the relay B 802 are relays that switch supply and shut off of power from the commercial AC power supply 550 to the load power-supply device 807. Namely, the relay A 801 and the relay B 802 act as a first switching unit and a second switching unit, respectively that switch supply and shut off of the alternating-current power.

The noise filter circuit 811 disposed upstream of the load power-supply device 807 filters out noise on the supply path over which power from the commercial AC power source 550 is supplied. The noise filter circuit 811 is comprised of a discharge resistor 803, an X-capacitor 804, and a common mode choke coil 805. The noise filter circuit 816 disposed upstream of the controller power-supply device 806 also filters out noise on the supply path over which the commercial AC power source 550 is supplied. As with the noise filter circuit 811 for the load power-supply device 807, the noise filter circuit 816 as well is comprised of a discharge resistor 817, an X-capacitor 818, and a common mode choke coil 819. The controller power-supply device 806 is supplied with power from the commercial AC power supply 550 even in power-saving mode as long as the power switch 812 is turned on. Namely, the number of times the controller power-supply device 806 is turned on/off of the power supply is considerably smaller than the number of times the load power-supply device 806 is turned on/off of the power supply. Therefore, no relay is provided upstream of the controller power-supply device 806 although the relays are provided upstream of the load power-supply device 807.

The load power-supply device 807 supplies DC power to the load 813 such as a motor, a clutch, and so on which carry out image forming operations in the color printer according to the present embodiment.

When the power switch 812 is turned on, and power from the commercial AC power supply 550 is supplied to the controller power-supply device 806, the controller power-supply device 806 outputs DC voltage to supply power to the controller 110. When the controller 110 is activated as a result, the controller 110 outputs a relay A control signal 814 and a relay B control signal 815 of a high level to a transistor 809 which drives the relay A and a transistor 810 which drives the relay B, respectively. In response to this, both the transistor 809 and the transistor 810 are turned on, causing the relay A 801 and the relay B 802 to be turned on. When the relay A 801 and the relay B 802 are turned on, power from the commercial AC power supply 550 is supplied to the load power-supply device 807 through the noise filter circuit 811. As a result, the load power-supply device 807 supplies DC power to the load 813.

Figure 4:
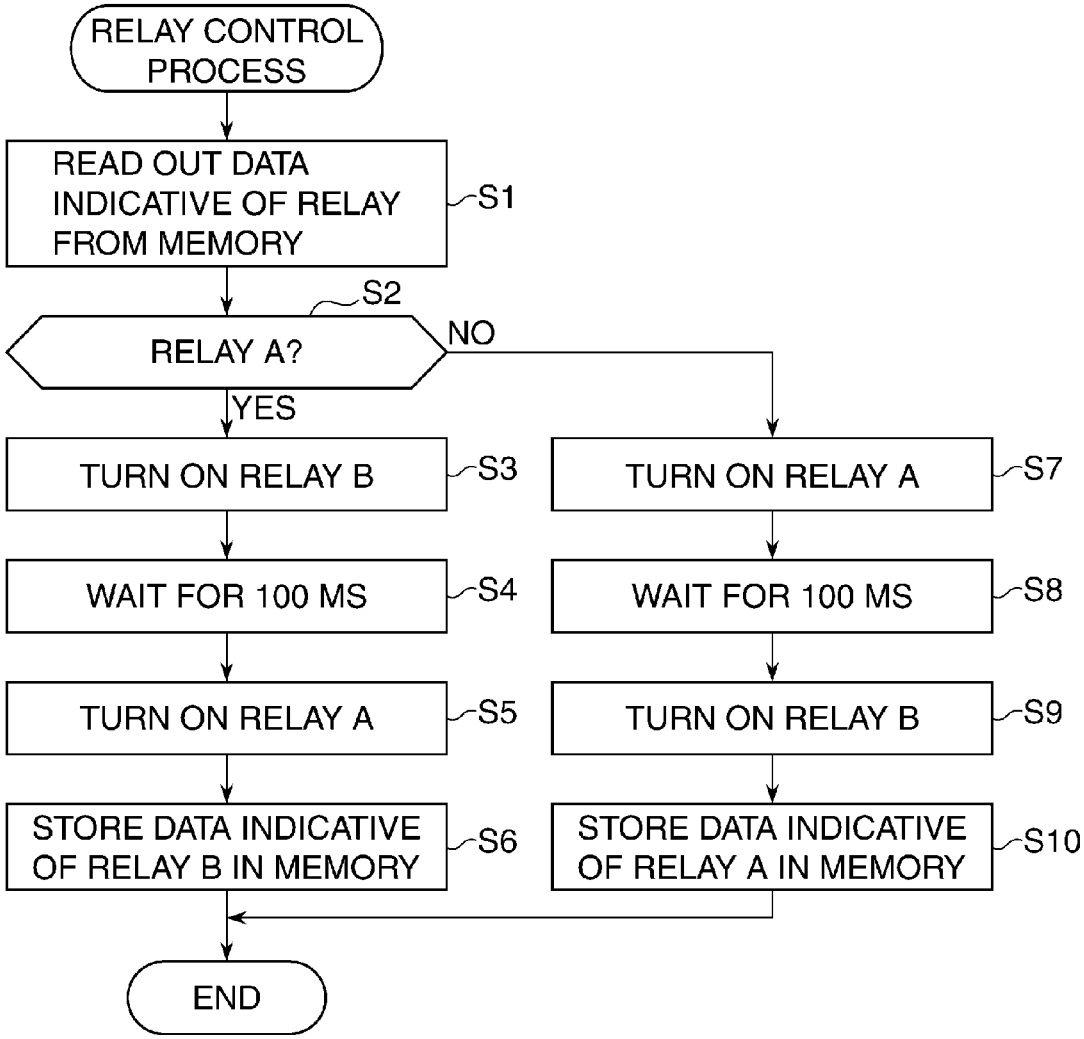
FIG. 4 is a flowchart showing the procedure of a relay control process carried out by the controller, in particular, a CPU appearing in FIG. 2.

FIG. 4 is a flowchart showing the procedure of a relay control process carried out by the controller 110, in particular, the CPU 171.

When the power switch 812 is turned on, and the controller 110 is activated, the present control process is started so as to start supplying power to the load power-supply device 807. First, the CPU 117 reads out data indicative of a relay-related history stored in the nonvolatile memory 176 (step S1). In the nonvolatile memory 176 (storage unit), data indicative of one of the relay A 801 and the relay B 802 which was turned first when the controller 110 was activated last time is stored (see steps S6 and S10, to be described later). In the step S1, data indicative of this relay-related history is read out. However, in a case where the power switch 812 is turned on first after the color printer according to the present embodiment is shipped from a factory, or in a case where the power switch 812 is turned on first after resetting the printer, no data indicative of a relay turned on first last time is stored in the nonvolatile memory 176. In this case, default data, for example, data indicative of the relay B should be written in the nonvolatile memory 176. It should be noted that information written in the nonvolatile memory 176 may be in any form (such as a flag) as long as which one of the relay A 801 and the relay B 802 has been turned on first is clear.

The CPU 171 then determines whether or not the data read out from the nonvolatile memory 176 is indicative of the relay A (step S2). When, as a result of the determination, the read data is indicative of the relay A, the CPU 171 determines a relay which should be turned on first as the relay B, and outputs the relay B control signal 815 to the transistor 810, thereby turning on the relay B 802 (step S3). The CPU 171 waits for 100 ms for example so as to reliably wait until the contact of the relay B 802 can be brought into stable contact (step S4). After that, the CPU 171 outputs the relay A control signal 814 to the transistor 809, thereby turning on the relay A 801 (step S5). The CPU 171 then stores, in the nonvolatile memory 176, data indicative of the relay B so that a relay turned on first this time can be specified later on (step S6), and thereafter, terminates the present relay control process.

On the other hand, when, as a result of the determination in the step S2, the read data is indicative of the relay B, the CPU 171 determines a relay which should be turned on first as the relay A, and outputs the relay A control signal 814 to the transistor 809, thereby turning on the relay A 801 (step S7). The CPU 171 then waits for 100 ms (step S8) in the same way as in the step S4, and thereafter, turns on the relay B 802 (step S9) in the same way as in the step S3. The CPU 171 then stores, in the nonvolatile memory 176, data indicative of the relay A turned on first this time (step S10), and thereafter, terminates the present relay control process.

It should be noted that although in the present embodiment, an object to which power from the commercial AC power supply 550 is supplied by way of the relay A 801, the relay B 802 and the noise filter circuit 811 is a DC power supply (the load power-supply device 807), this is not limitative, but a fixing heater or the like as an alternating-current load may be used.

Thus, in the present embodiment, with respect to a plurality of (in the present embodiment, two) relays, the number of times each of the relays is turned on first is leveled out so that inrush current can be equally passed through them. As a result, the number of times each of the relays is turned on first is smaller than the number of times the power to the apparatus is turned on, and the life of relay contacts can be extended.

A color printer according to a second embodiment differs from the color printer according to the first embodiment described above only in part of the power-supply unit 800 and part of the relay control process. Therefore, the hardware of the color printer according to the first embodiment, that is, the hardware shown FIGS. 1 and 2 is adopted as hardware of the color printer according to the present embodiment.

Figure 5:
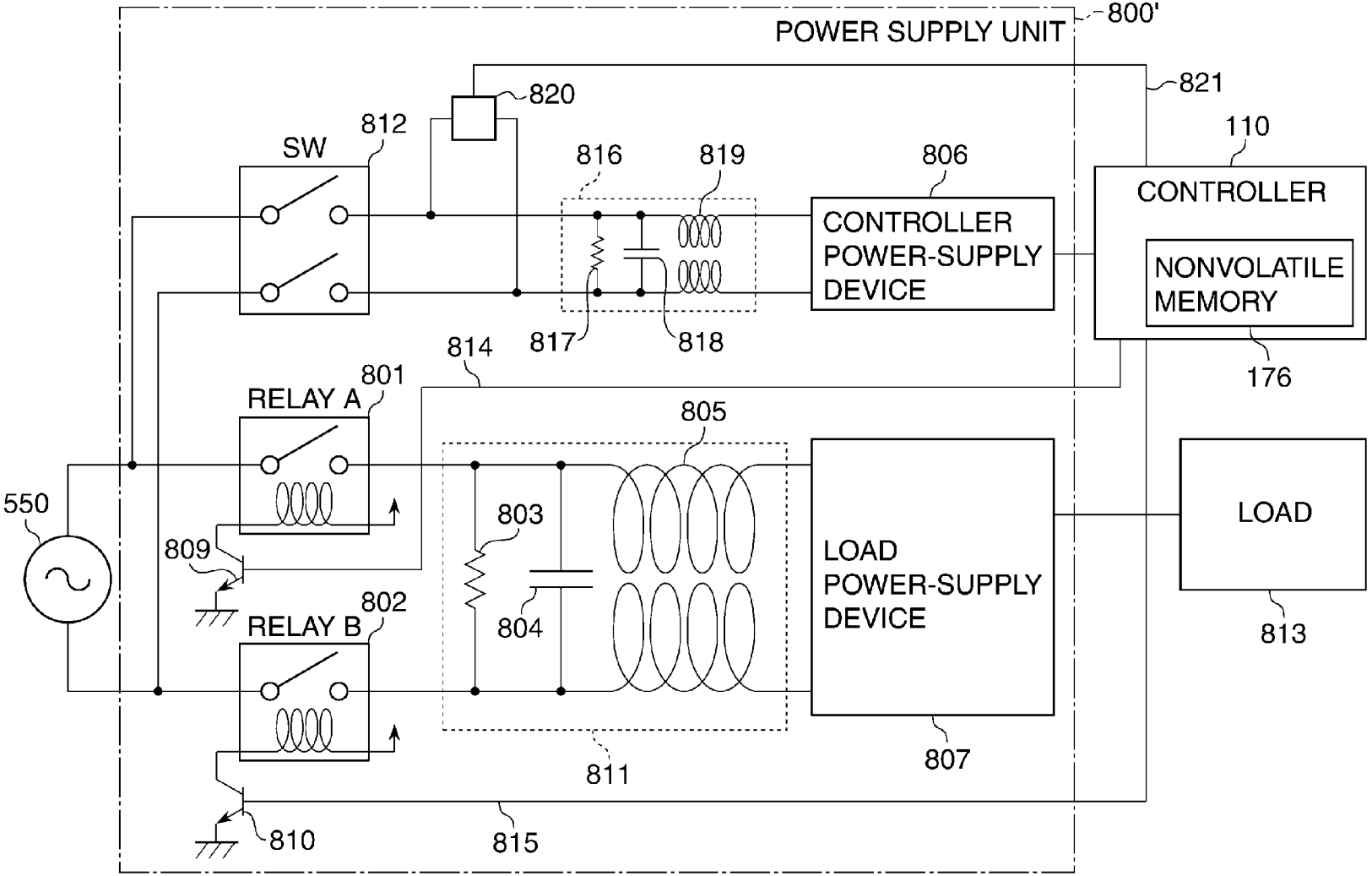
FIG. 5 is a diagram showing in detail an arrangement of a power-supply device in a color printer to which an image forming apparatus according to a second embodiment of the present invention is applied.

FIG. 5 is a diagram showing in detail an arrangement of a power-supply unit 800' appearing in FIG. 2, and corresponds to FIG. 3 relating to the color printer according to the first embodiment. In FIG. 5, elements corresponding to those in FIG. 2 are designated by the same reference symbols, and description thereof is omitted.

The power-supply unit 800' has a zero cross detection unit 820 that detects zero cross timing of the alternate-current power supplied from the commercial AC power supply 550. When the power switch 812 is turned on, and the alternate-current power from the commercial AC power supply 550 is supplied, the zero cross detection unit 820 outputs a zero cross detection signal 821 in accordance with zero cross timing of the alternate-current power. Namely, the zero cross detection unit 820 acts as a detection unit. The zero cross detection signal 821 is input to the I/O port 173 (see FIG. 2) in the controller 110.

Figure 6:
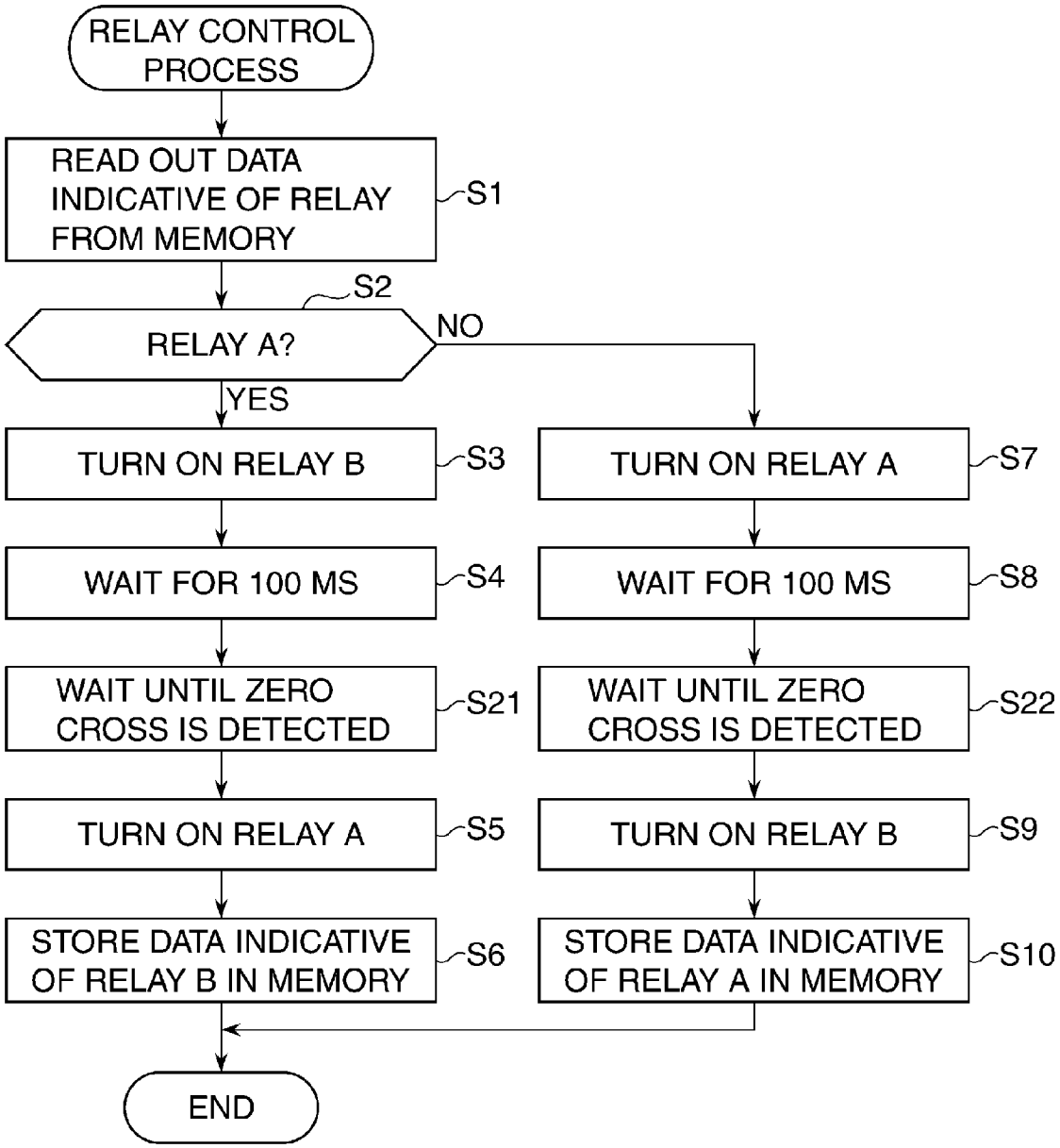
FIG. 6 is a flowchart showing the procedure of a relay control process carried out by a controller, in particular, a CPU appearing in FIG. 5.

FIG. 6 is a flowchart showing the procedure of a relay control process carried out by the controller 110, in particular, the CPU 171 and corresponds to FIG. 4 relating to the color printer according to the first embodiment. In FIG. 6, steps in which the same processes as those in FIG. 4 are carried out are designated by the same reference symbols, and description of these processes is omitted when appropriate.

When data indicative of a relay-related history read out from the nonvolatile memory 176 is indicative of the relay A, the CPU 171 carries out the processes in the steps S3 and S4 and then waits until the zero cross detection signal 821 is input (step S21). When a relay is turned on with the voltage of the commercial AC power supply 550 being low, the amount of inrush current flowing through a relay contact decreases, resulting in a reduction in the amount of arc discharge. Namely, turning on a relay near the zero cross timing of the commercial AC power supply 550 is more advantageous for extension of the life of a relay contact. Therefore, the CPU 171 waits until the zero cross detection signal 821 is input, and turns on the relay A 801 in synchronization with zero cross timing (step S5). The CPU 171 then carries out the process in the step S6 and terminates the present relay control process.

On the other hand, processes carried out when data indicative of a relay-related history read out from the nonvolatile memory 176 is indicative of the relay B, that is, the processes in the steps S7, S8, S22, S9, and S10 are the same as the processes in the steps S3, S4, S21, S5, and S6 except for a relay to be targeted, and therefore, description thereof is omitted.

As described above, according to the present embodiment, because a relay which should be turned on later is turned on in synchronization with zero cross timing, the amount of inrush current flowing through the relay can be decreased, that is, the amount of arc discharge can be reduced. As a result, the life of a relay contact can be extended to a greater degree than in the first embodiment.

A color printer according to a third embodiment differs from the color printer according to the first embodiment described above only in part of the relay control process. Therefore, the hardware of the color printer according to the first embodiment, that is, the hardware shown in FIGS. 1 to 3 is adopted as it is as hardware of the color printer according to the present embodiment.

Figure 7A:
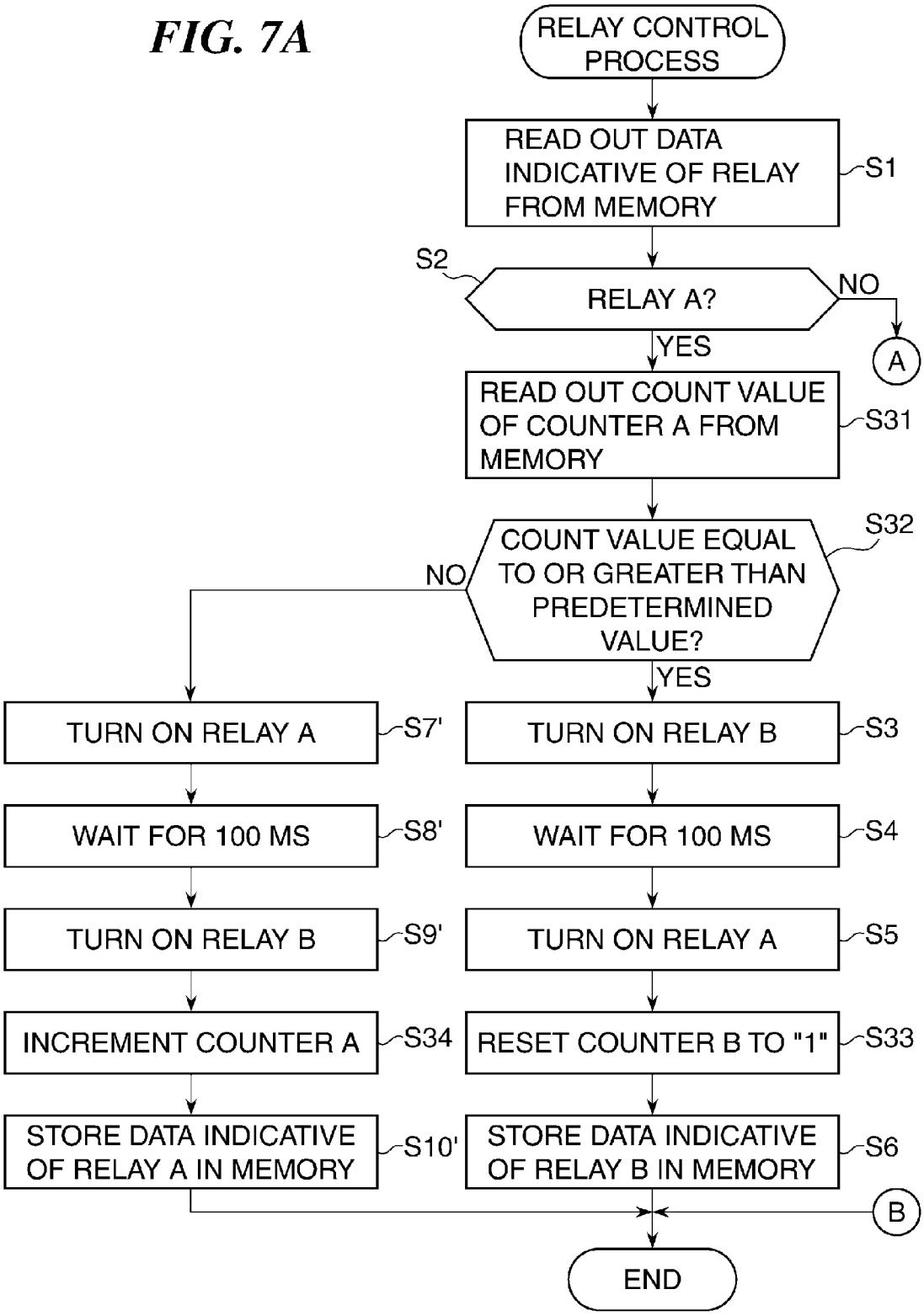
FIGS. 7A and 7B are flowcharts showing the procedure of a relay control process carried out by a controller, in particular, a CPU in a color printer to which an image forming apparatus according to a third embodiment of the present invention is applied.
Figure 7B:
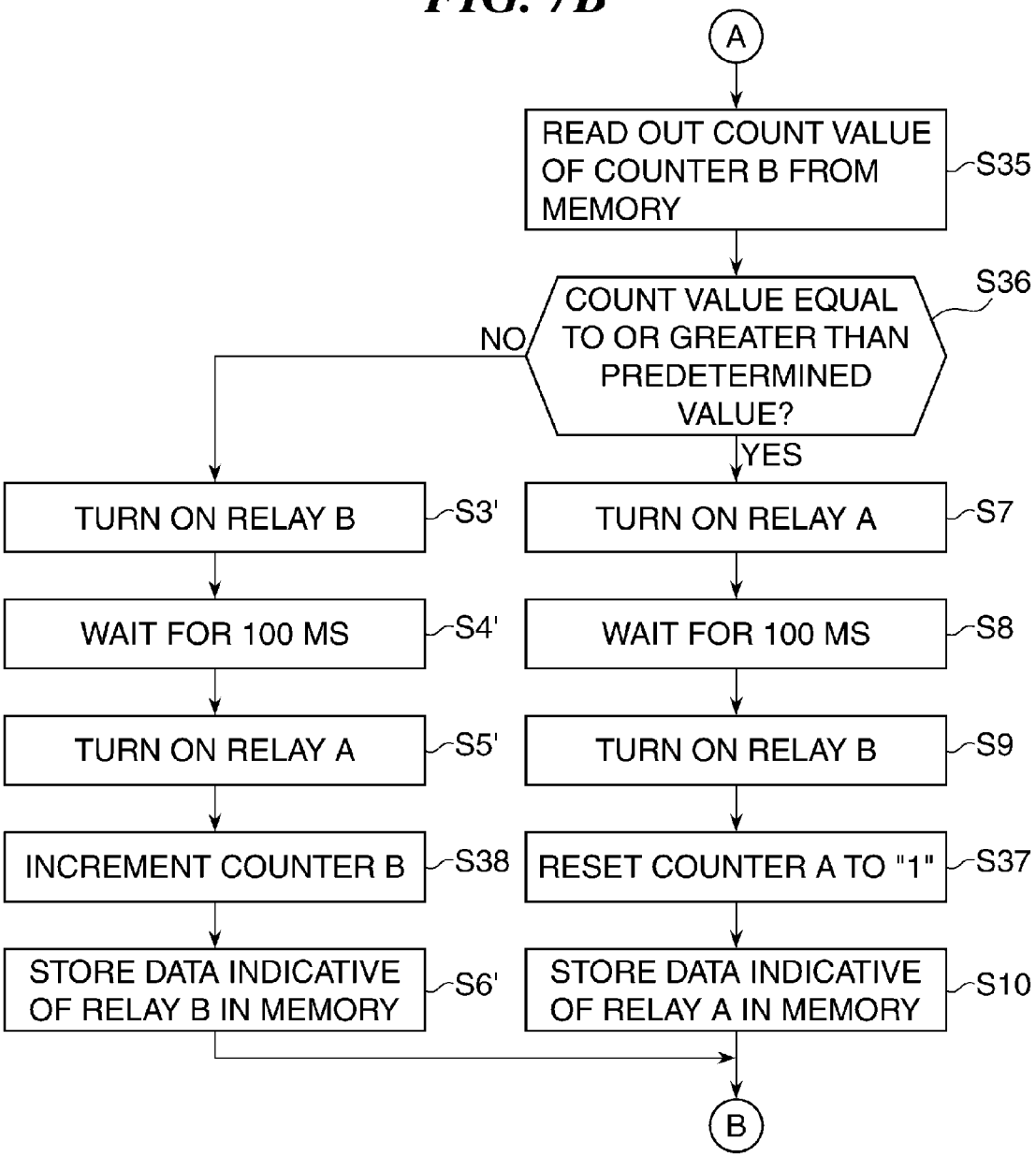

FIGS. 7A and 7B are flowcharts showing the procedure of a relay control process carried out by the controller 110, in particular, the CPU 171, and corresponds to FIG. 4 relating to the color printer according to the first embodiment. In FIGS. 7A and 7B, steps in which the same processes as those in FIG. 4 are carried out are designated by the same reference symbols, and description of these processes is omitted as needed.

When data indicative of a relay read out from the nonvolatile memory 176 is indicative of the relay A, the CPU 171 reads out the count value of a counter A (not shown) provided in the nonvolatile memory 176 (step S31). The counter A (count unit) is intended to count the number of times the relay A 801 is successively turned on first.

The CPU 171 then determines whether or not the count value of the counter A has reached a predetermined number (step S32). When the count value of the counter A has reached the predetermined number, the CPU 171 carries out the processes in the steps S3 to S5. The CPU 171 then resets the count value of a counter B (not shown), which is provided in the nonvolatile memory 176, to "1" (step S33). The counter B (count unit) is intended to count the number of times the relay B 802 is successively turned on first. The CPU 171 then carries out the process in the step S6, and after that, terminates the present relay control process.

On the other hand, when, as a result of the determination in the step S32, the count value of the counter A has not reached the predetermined number, the CPU 171 carries out process in steps S7' to S9'. The processes in the steps S7' to S9' are the same as the processes in the steps S7 to S9, respectively. The CPU 171 then increments the count value of the counter A by "1" (step S34). The CPU 171 then carries out the process in the step S10', and terminates the present relay control process. The process in the step S10' is the same as the process in the step S10.

On the other hand, when the data indicative of the relay-related history read out from the nonvolatile memory 176 is indicative of the relay B, the CPU 171 reads out the count value of the counter B from the nonvolatile memory 176. The CPU 171 then determines whether or not the count value of the counter B has reached a predetermined number (step S36). When, as a result of the determination, the count value of the counter B has reached the predetermined number, the CPU 171 carries out the processes in the steps S7 to S9. The CPU 171 then resets the count value of the counter A to "1" (step S37). The CPU 171 then carries out the process in the step S10, and after that, terminates the present relay control process.

On the other hand, when, as a result of the determination in the step S36, the count value of the counter B has not reached the predetermined number, the CPU 171 carries out processes in steps S3' to S5'. The processes in the steps S3' to S5' are the same as the processes in the steps S3 to S5, respectively. The CPU 171 then increments the count value of the counter B by "1" (step S38). The CPU 171 then carries out a process in step S6' and then terminates the present relay control process. The process in the step S6' is the same as the process in the step S6.

Thus, in the present embodiment, with respect to a plurality of (in the present embodiment, two) relays, the relay which should be turned on first is successively switched every predetermined number of times that power supply is turned on. As a result, the number of times each of the relays is turned on first is leveled out and becomes smaller than the number of times the power to the color printer according to the present embodiment is turned on, and the life of the relay contacts can be extended.

According to any of the embodiments described above, because the relays are on-off controlled so that the number of times each relay is turned on first per predetermined number of times power is supplied can be substantially equal between the relays, the life of each relay contact can be extended.

OTHER EMBODIMENTS

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-146879 filed Jun. 29, 2012, which is hereby incorporated by reference herein in its entirety.

What is claimed is:

1. An image forming apparatus comprising:

first and second switching units configured to be disposed in respective ones of two supply paths that are different in polarity and over which alternating-current power from a commercial alternating-current power supply is supplied, and switch supply and shut off of the alternating-current power;

noise filter circuits configured to be disposed downstream of said first and second switching units and filter out noise on the two supply paths;

a power supplied device configured to be disposed downstream of said noise filter circuit and be supplied with the alternating-current power through said noise filter circuit; and a control unit configured to, when supply of the alternating-current power from the commercial alternating-current power supply to said power supplied device is started, control said first and second switching units to switch one of said first and second switching units into supply state and then switch the other one of said first and second switching units into supply state so that the number of times said first switching unit is switched into supply state first and the number of times said second switching unit is switched into supply state first can be substantially equal per predetermined number of times the alternating-current power is supplied to said power supplied device.

2. The image forming apparatus according to claim 1, further comprising a storage unit configured to store information that specifies one of said first and second switching units switched into supply state first by said control unit, wherein, said control unit determines which one of said first and second switching units should be switched into supply state first based on the information stored in said storage unit.

3. The image forming apparatus according to claim 2, wherein said control unit switches said second switching unit into supply state first in a case where the information stored in said storage unit is information specifying said first switching unit, and switches said first switching unit into supply state first in a case where the information stored in said storage unit is information specifying said second switching unit.

4. The image forming apparatus according to claim 1, further comprising a detection unit configured to detect zero cross timing of the alternating-current power, wherein said control unit controls said first and second switching units so as to switch the one of said first and second switching units into supply state first and then switch the other one of said first and second switching units into supply state in synchronization with detection of zero cross timing by said detection unit.

5. The image forming apparatus according to claim 2, further comprising:

a count unit configured to count the number of times the one of said first and second switching units switched into supply state first by said control unit is successively switched into supply state first, wherein in a case where the information stored in said storage unit is the information specifying said first switching unit, said control unit switches said first switching unit into supply state first if the number of times said counter unit has counted does not reach a predetermined number, and switches said second switching unit into supply state first if the number of times said counter unit has counted reaches the predetermined number.

6. The image forming apparatus according to claim 5, wherein in a case where the information stored in said storage unit is information specifying said second switching unit, said control unit switches said second switching unit into supply state first if the number of times said counter unit has counted does not reach the predetermined number, and switches said first switching unit into supply state first if the number of time said counter unit has counted reaches the predetermined number.

7. The image forming apparatus according to claim 1, wherein said noise filter circuits comprise an X-capacitor for filtering out noise on the two supply paths and a discharge resistor for discharging residual electric charge remaining in the X-capacitor.

8. The image forming apparatus according to claim 1, wherein said first and second switching units comprise relays.

9. The image forming apparatus according to claim 1, wherein said storage unit comprises a nonvolatile memory.

10. The image forming apparatus according to claim 1, wherein said power supplied device comprises a power circuit for converting the alternating-current power into direct-current power.

11. An image forming apparatus comprising:

first and second switching units configured to be disposed in respective ones of two supply paths that are different in polarity and over which alternating-current power from a commercial alternating-current power supply is supplied and switch supply and shut off of the alternating-current power;

noise filter circuits configured to be disposed downstream of said first and second switching units and filter out noise on the two supply paths;

a power supplied device configured to be disposed downstream of said noise filter circuits and be supplied with the alternating-current power through said noise filter circuit;

a control unit configured to, when supply of the alternating-current power from the commercial alternating-current power supply to said power supplied device is started, switch one of said first and second switching units into supply state and then switch the other one of said first and second switching units into supply state; and a storage unit configured to store information that specifies the one of said first and second switching units switched into supply state first when supply of the alternating-current power from the commercial alternating-current power supply to said power supplied device is started last time, wherein every time supply of the alternating-current power from the commercial alternating-current power supply to said power supplied device is started, said control unit determines which one of said first and second switching units should be switched into supply state first based on the information stored in said storage unit.

12. The image forming apparatus according to claim 11, wherein said control unit controls said first and second switching units so as to alternately switch one of said first and second switching unit into supply state first every time supply of the alternating-current power from the commercial alternating-current power supply to said power supplied device is started.

13. The image forming apparatus according to claim 11, further comprising a detection unit configured to detect zero cross timing of the alternating-current power, wherein said control unit controls said first and second switching units so as to switch the one of said first and second switching units into supply state first and then switch the other one of said first and second switching units into supply state in synchronization with detection of the zero cross timing by said detection unit.

14. The image forming apparatus according to claim 11, wherein said noise filter circuit comprises an X-capacitor for filtering out noise on the two supply paths and a discharge register for discharging residual electric charge remaining in the X-capacitor.

15. The image forming apparatus according to claim 11, wherein said first and second switching unit comprise relays.

* * * * *